US007396994B2

(12) United States Patent
Izumi

(10) Patent No.: US 7,396,994 B2
(45) Date of Patent: Jul. 8, 2008

(54) ELECTRONIC KEYBOARD INSTRUMENT

(75) Inventor: Ryuichi Izumi, Hamamatsu (JP)

(73) Assignee: Yamaha Corporation, Hamamatsu-Shi (JP)

( * ) Notice: Subject to any disclaimer, the term of this patent is extended or adjusted under 35 U.S.C. 154(b) by 534 days.

(21) Appl. No.: 11/036,434

(22) Filed: Jan. 13, 2005

(65) Prior Publication Data

US 2005/0150367 A1 Jul. 14, 2005

(30) Foreign Application Priority Data

Jan. 14, 2004 (JP) ..... 2004-006410

(51) Int. Cl.
*G10H 1/32* (2006.01)
*G10H 3/00* (2006.01)

(52) U.S. Cl. ..... 84/746; 84/DIG. 17

(58) Field of Classification Search ..... 84/743, 84/744, 746, DIG. 17
See application file for complete search history.

(56) References Cited

U.S. PATENT DOCUMENTS 3,643,000 A * 2/1972 Andersen ..... 84/600
4,656,913 A * 4/1987 Yoshikawa ..... 84/177
5,335,283 A * 8/1994 Torii ..... 381/118
5,789,693 A * 8/1998 Lawson ..... 84/744
6,828,497 B2 * 12/2004 Yataka et al. ..... 84/625
6,916,980 B2 * 7/2005 Ishida et al. ..... 84/743

FOREIGN PATENT DOCUMENTS

JP 58-18295 2/1983
JP 63-5693 1/1988
JP 5-52893 U 7/1993

* cited by examiner

*Primary Examiner*—Jeffrey Donels
(74) *Attorney, Agent, or Firm*—Morrison & Foerster LLP

(57) ABSTRACT

An electronic keyboard instrument includes a keyboard attachment frame section having a keyboard section; a rear frame section joined to a rear portion of the lower surface of the keyboard attachment frame section and having pedals provided at its bottom portion; and an electronic circuit that generates heat when activated and includes a power transformer and an amplifier. The electronic circuit is vertically provided on the inner surface of a rear body section of the rear frame section. Hole portions and ventilation holes are provided at a bottom portion of the rear body section. Ventilation holes are provided at the keyboard attachment frame section.

18 Claims, 7 Drawing Sheets

ELECTRONIC KEYBOARD INSTRUMENT

BACKGROUND OF THE INVENTION

1. Field of the Invention

The present invention relates to an electronic keyboard instrument having an electronic circuit that generates heat when activated.

2. Description of the Related Art

Conventionally, an electronic keyboard instrument having a keyboard is used for musical performance. The electronic keyboard instrument has an electronic circuit that includes a power unit, a transformer, and various circuit boards. Such an electronic circuit of the electronic keyboard instrument is generally provided under or behind a keyboard in an instrument body. Accordingly, a portion of the instrument body located under or behind the keyboard assumes a large size, resulting in an increase in the overall size of the electronic keyboard instrument.

For size reduction, a certain electronic keyboard instrument (as disclosed in, for example, Japanese Utility Model Application Laid-Open (kokai) No. 5-52893) is configured as follows: a power unit and a transformer are provided on a bottom plate in the interior of a rear frame section which supports a rear portion of an instrument body; and a panel on which a computer board, and a drive circuit board for driving keys and pedals are mounted is provided above the power unit and the transformer in the interior of the rear frame section.

However, in the course of musical performance by the above-mentioned electronic keyboard instrument in which the electronic circuit including the power unit is provided in the interior of the rear frame section, the power unit and the transformer generate heat, and the heat ascends in the interior of the rear frame section. Accordingly, in the electronic keyboard instrument, the heat ascending in the interior of the rear frame section heats the panel located above the power unit and the transformer. The drive circuit board mounted on the panel including components susceptible to heat. The above-mentioned electronic keyboard instrument involves a problem that heat deteriorates those components susceptible to heat or shortens their life.

SUMMARY OF THE INVENTION

The present invention has been accomplished in view of the above problems, and an object of the invention is to provide an electronic keyboard instrument whose size can be reduced by means of reducing the height and depth of its body and in which thermal deterioration or a like problem in an electronic circuit can be prevented.

To achieve the above object, the present invention provides an electronic keyboard instrument comprising a frame body and an electronic circuit. The frame body comprises a keyboard attachment frame section and a rear frame section and has a space section formed therein. The keyboard attachment frame section has a keyboard. The rear frame section is connected to a rear portion of a lower surface of the keyboard attachment frame section and has a foot controller provided at a bottom portion thereof or provided therebelow via a connection section. The electronic circuit generates heat when activated. In the electronic keyboard instrument, the electronic circuit is provided in the interior of the rear frame section; and a ventilation hole communicating with the exterior of the rear frame section is provided at a lower portion of the rear frame section and provided at a portion of the frame body located above the electronic circuit.

In the thus-configured electronic keyboard instrument of the present invention, the electronic circuit is provided in the interior of the rear frame section, thereby preventing an increase in size with respect to a portion of the keyboard attachment frame section located below the keyboard and a portion of the keyboard attachment frame section located behind the keyboard. As a result, the overall size of the electronic keyboard instrument can be reduced. Also, since the ventilation hole is provided at upper and lower portions of the frame body, air enters through one ventilation hole and exits through the other ventilation hole, whereby air can flow through the frame body. In this case, preferably, air flows in such a manner that air enters the rear frame section through the lower ventilation hole and exits to the exterior of the rear frame section through the upper ventilation hole.

Such air flow efficiently carries heat generated from the electronic circuit to the exterior of the rear frame section through the upper ventilation hole. Thus, stagnation of heat in the interior of the rear frame section is prevented, thereby preventing heating, to high temperature, of various circuit boards and devices that constitute the electronic circuit. As a result, even when the electronic circuit includes components susceptible to heat, the electronic circuit operates properly.

In this case, the upper ventilation hole is provided above the electronic circuit, whereas the lower ventilation hole may be provided below or above the electronic circuit. The upper ventilation hole may be provided at the rear frame section or the keyboard attachment frame section, so long as the electronic circuit is located in or in the vicinity of the path of air flowing between the upper and lower ventilation holes, so that air flow carries heat generated from the electronic circuit to the exterior of the frame body.

The foot controller may be provided at a bottom portion of the rear frame section or at a lower end portion of a connection section attached to the lower surface of the rear frame section. In the case where the foot controller is provided at a bottom portion of the rear frame section, a projection opening from which the foot controller in the form of a pedal projects can be used as the lower ventilation hole. Furthermore, a power line inlet is generally provided at the rear surface of an electronic keyboard instrument. The ventilation hole according to the present invention may be provided in a peripheral region of the power line inlet.

According to another configurational feature of the electronic keyboard instrument of the present invention, the electronic circuit is formed on a predetermined plane, and is disposed vertically in such a manner that the plane extends along an inner wall surface of the rear frame section.

The above feature allows a reduction in the depth of the rear frame section, thereby allowing a reduction in the size of the electronic keyboard instrument. In the case where the lower ventilation hole is provided below the electronic circuit, air that enters the rear frame section through the lower ventilation hole ascends along the surface of the electronic circuit, so that heat generated from the electronic circuit can be efficiently released from the upper ventilation hole to the exterior of the rear frame section. In this case, the predetermined plane may be a flat plate or an imaginary plane. In the case where the predetermined plane is an imaginary plane, devices that constitute the electronic circuit are two-dimensionally arranged on the inner wall surface of the rear frame section.

BRIEF DESCRIPTION OF THE DRAWINGS

Various other objects, features and many of the attendant advantages of the present invention will be readily appreciated as the same becomes better understood by reference to the following detailed description of the preferred embodiment when considered in connection with the accompanying drawings, in which.

DESCRIPTION OF THE PREFERRED EMBODIMENT

Figure 1:
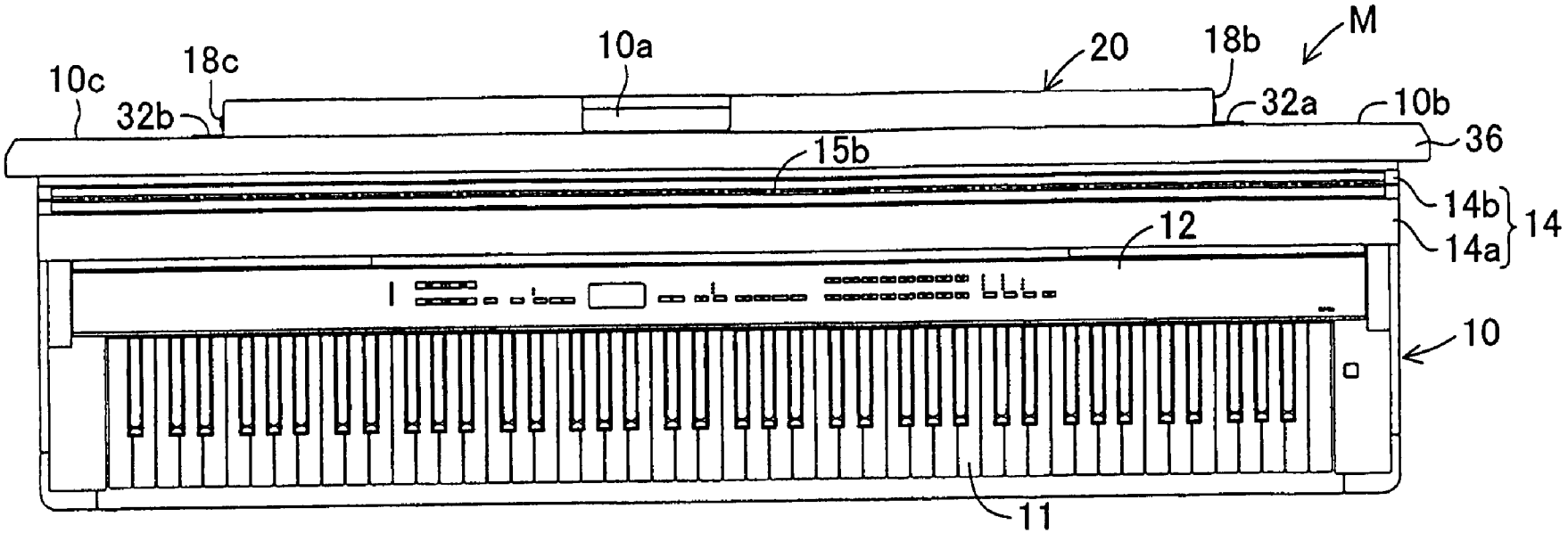
FIG. 1 is a plan view showing an electronic keyboard instrument according to an embodiment of the present invention.
Figure 2:
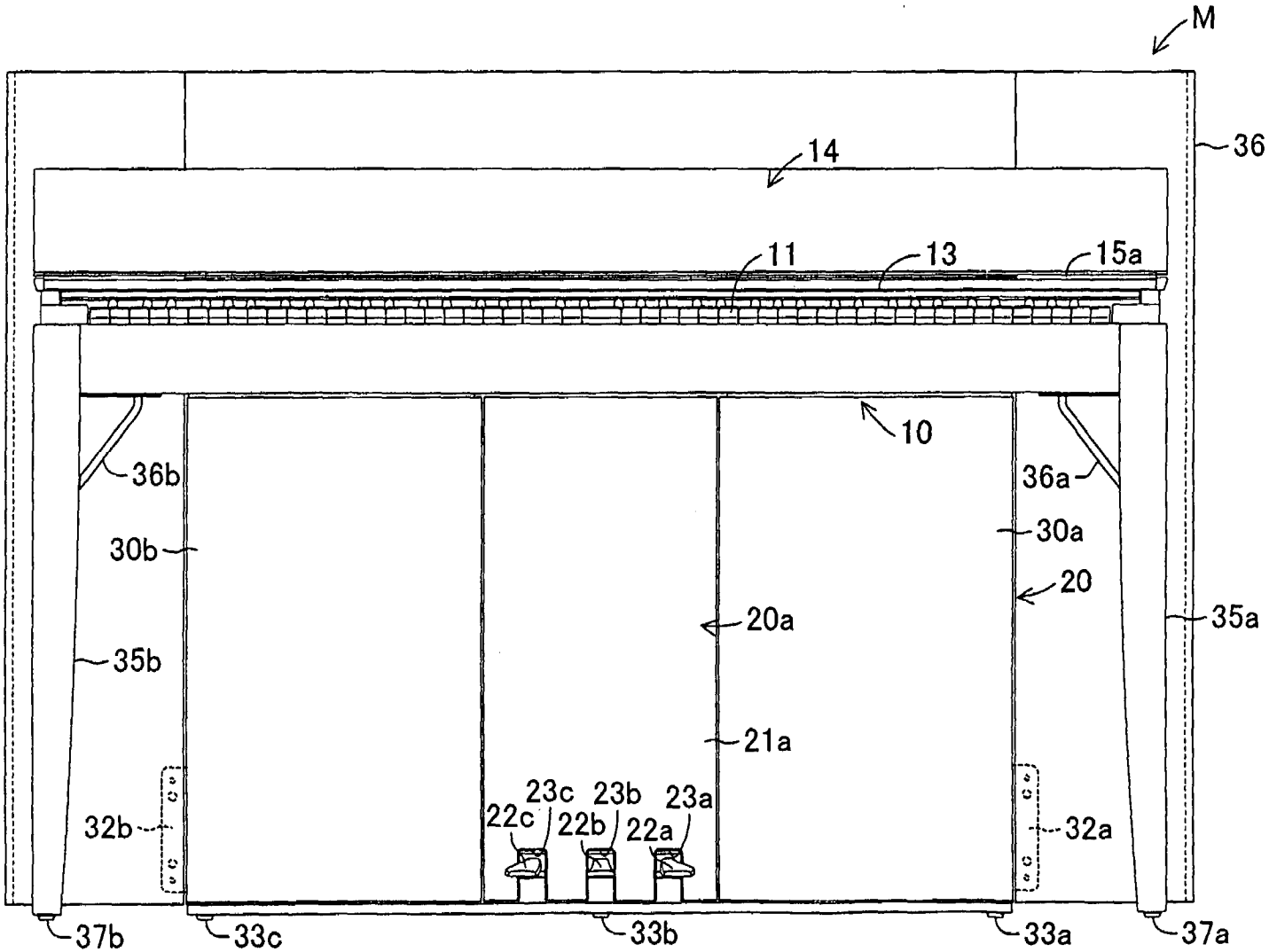
FIG. 2 is a front view of the electronic keyboard instrument of FIG. 1.
Figure 3:
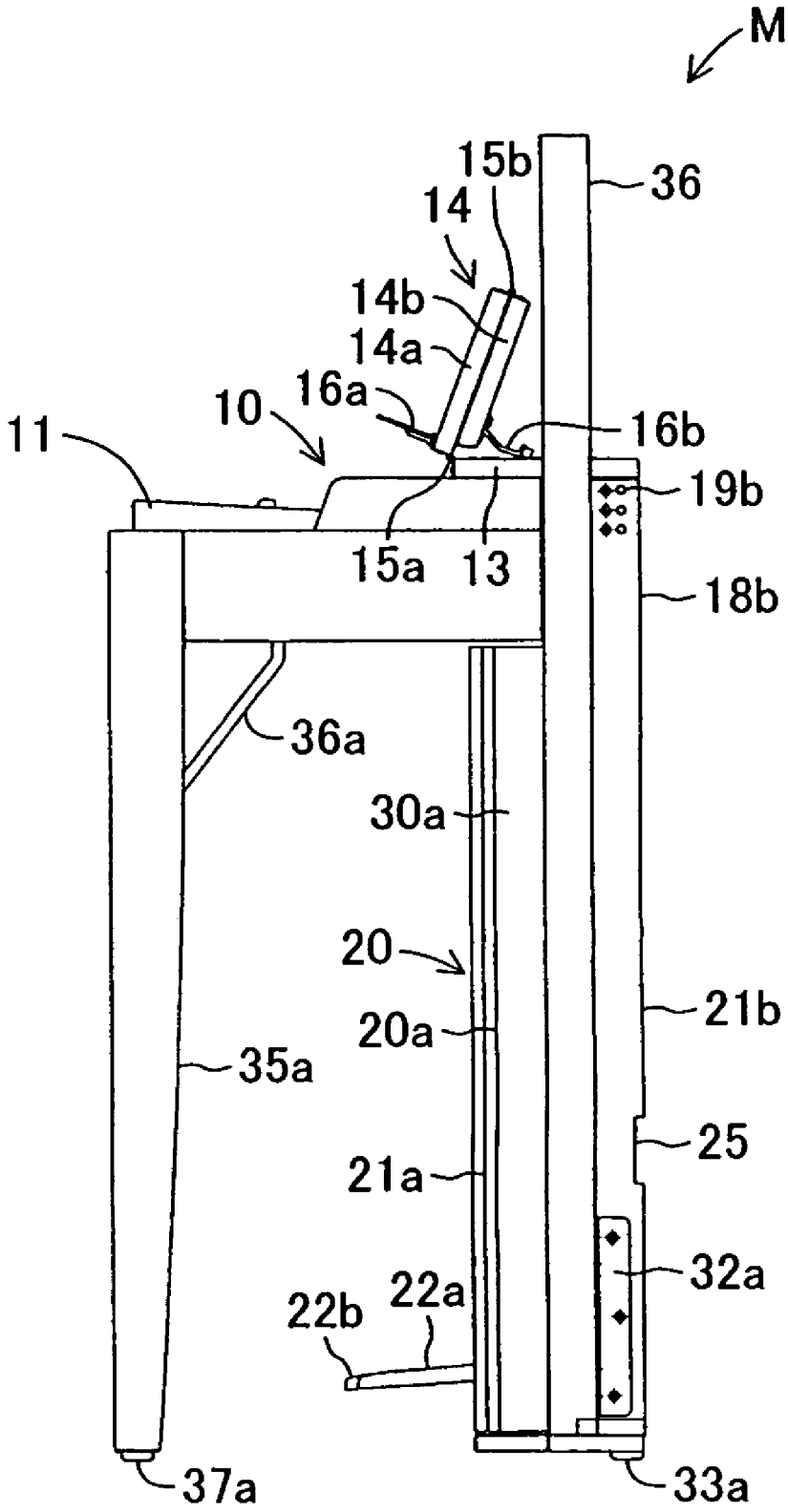
FIG. 3 is a side view of the electronic keyboard instrument of FIG. 1.

An embodiment of the present invention will next be described in detail with reference to the drawings. FIGS. 1 to 3 show an electronic keyboard instrument M according to the present invention. The electronic keyboard instrument M includes a keyboard attachment frame section 10; a rear frame section 20, which supports a rear central portion of the keyboard attachment frame section 10; and leg sections 35*a* and 35*b*, which support corresponding front opposite side portions of the keyboard attachment frame section 10. A portal panel 36 is attached to the rear surface of the keyboard attachment frame section 10 in such a manner as to surround opposite side portions and a top portion of the rear frame section 20 at a substantially central position with respect to the depth direction.

As shown in FIGS. 1 and 2, the keyboard attachment frame section 10 assumes a box-like form having a long length in the width direction and a short length in the height direction. A keyboard section 11 is provided on the upper surface of the keyboard attachment frame section 10 on a side toward a performer. The keyboard section 11 includes a plurality of keys for playing the electronic keyboard instrument M. An operation panel section 12 is provided behind the keyboard section 11 on the upper surface of the keyboard attachment frame section 10. The operation panel section 12 includes a plurality of controllers. A ceiling section 13 is formed behind the operation panel section 12 on the upper surface of the keyboard attachment frame section 10. The ceiling section 13 is higher in level than the keyboard section 11 and the operation panel section 12. A folding cover section 14 is hinged to the front end surface of the ceiling section 13.

The cover section 14 includes a rear cover 14*a* and a front cover 14*b*. In the closed state of the cover section 14, an upper edge portion of the front end surface of the ceiling section 13 and an upper edge portion of the rear end surface of the rear cover 14*a* are connected by means of a hinge 15*a*; and an upper edge portion of the front end surface of the rear cover 14*a* and an upper edge portion of the rear end surface of the front cover 14*b* are connected by means of a hinge 15*b*. From the state of FIG. 3, the rear cover 14*a* and the front cover 14*b* which are in a folded condition are rotated frontward together about the hinge 15*a*. Then, the front cover 14*b* is rotated frontward about the hinge 15*b*. As a result, the front and rear covers 14*b* and 14*a* cover the keyboard section 11 and the operation panel section 12.

Figure 4:
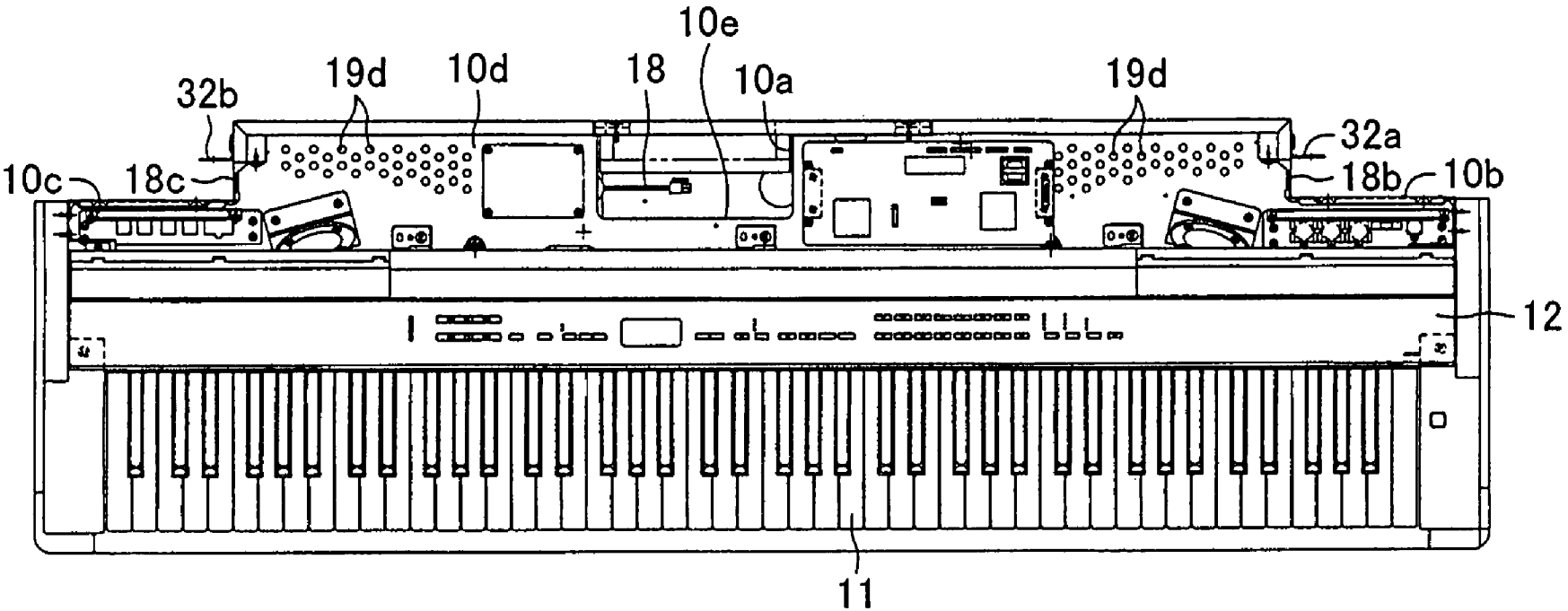
FIG. 4 is a plan view showing the electronic keyboard instrument of FIG. 1 from which a panel, a ceiling section, and a cover section are removed.
Figure 5:
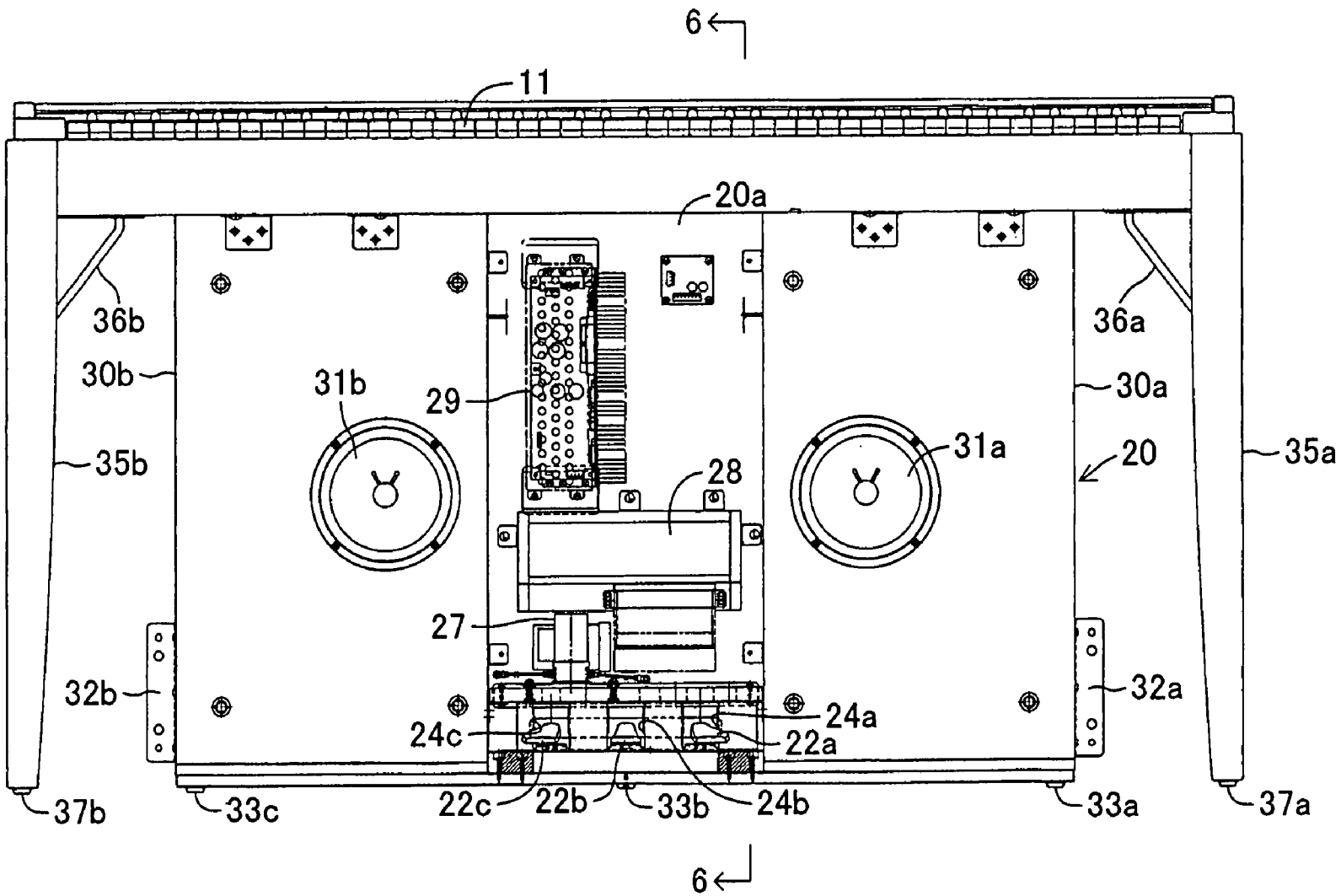
FIG. 5 is a front view showing the interior of a rear frame section of the electronic keyboard instrument shown in FIG. 4.
Figure 6:
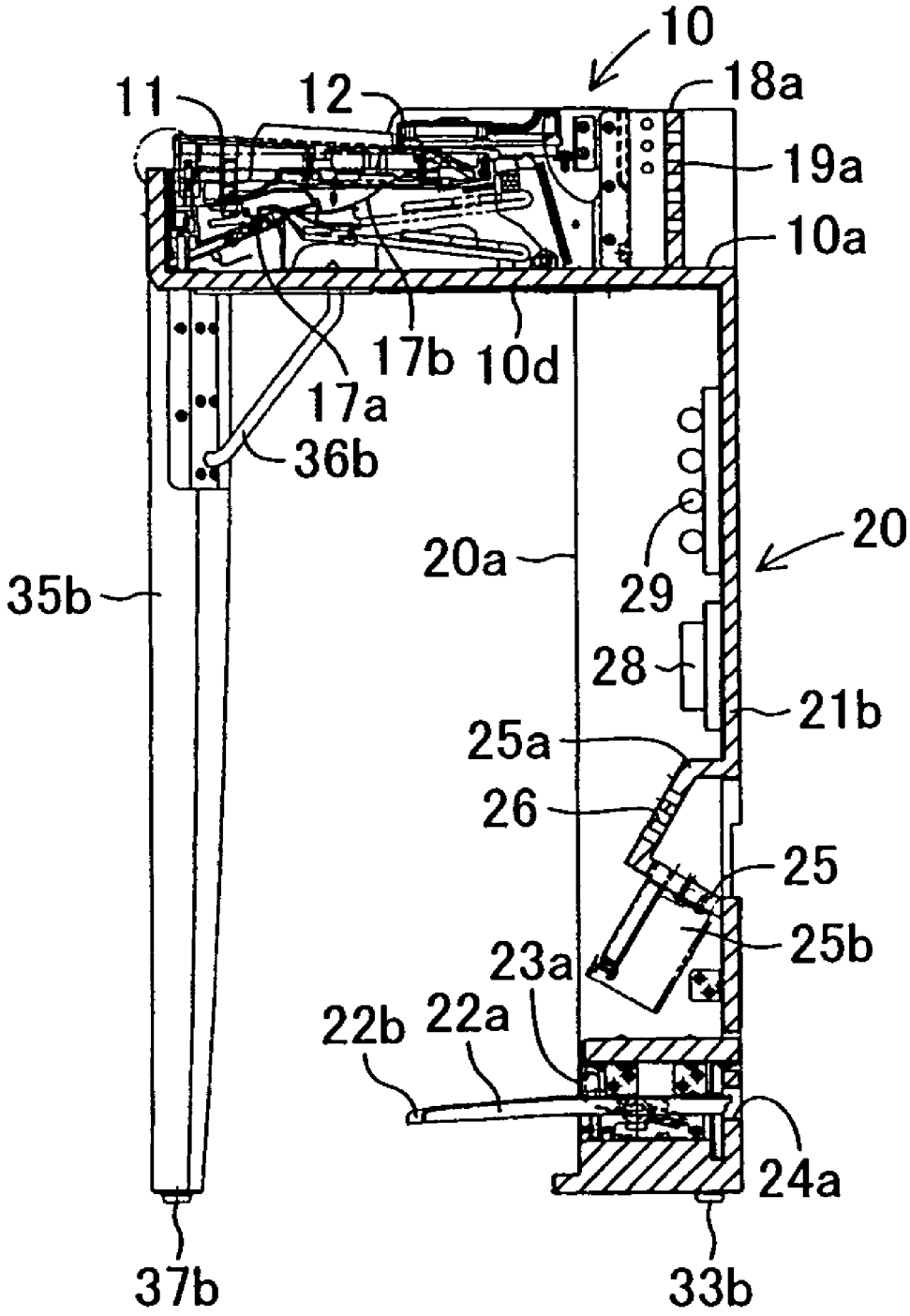
FIG. 6 is a sectional view taken along line 6-6 of FIG. 5.

A music stand 16*a* is hinged to the center of a rear edge portion of the lower surface of the rear cover 14*a* in a foldable condition. A support portion 16*b* is provided at the center of a front end portion of the lower surface of the front cover 14*b* in order to support the cover section 14 in a standing condition when the cover section 14 is opened and folded. FIGS. 4 to 6 shows the electronic keyboard instrument M, from which the ceiling section 13, the cover section 14, and the panel 36 are removed, in a state in which the interior of the keyboard attachment frame section 10 and the interior of the rear frame section 20 are exposed.

As shown in FIG. 6, a detection device 17*a* and a return mechanism 17*b* are disposed below the keyboard section 11 and the operation panel section 12 in the interior of the keyboard attachment frame section 10. The detection device 17*a* is adapted to detect, for example, a key-pressing force generated upon operation of a key. The return mechanism 17*b* is adapted to limit upper and lower positions of individual keys and to return a pressed key to its upper-limit position. The detection device 17*a* includes actuators, sensors, and a switch board. The return mechanism 17*b* includes return springs, and stoppers for setting upper- and lower-limit positions of individual keys. A circuit board that generates no heat or little heat is disposed in the interior of the keyboard attachment frame section 10.

Figure 7:
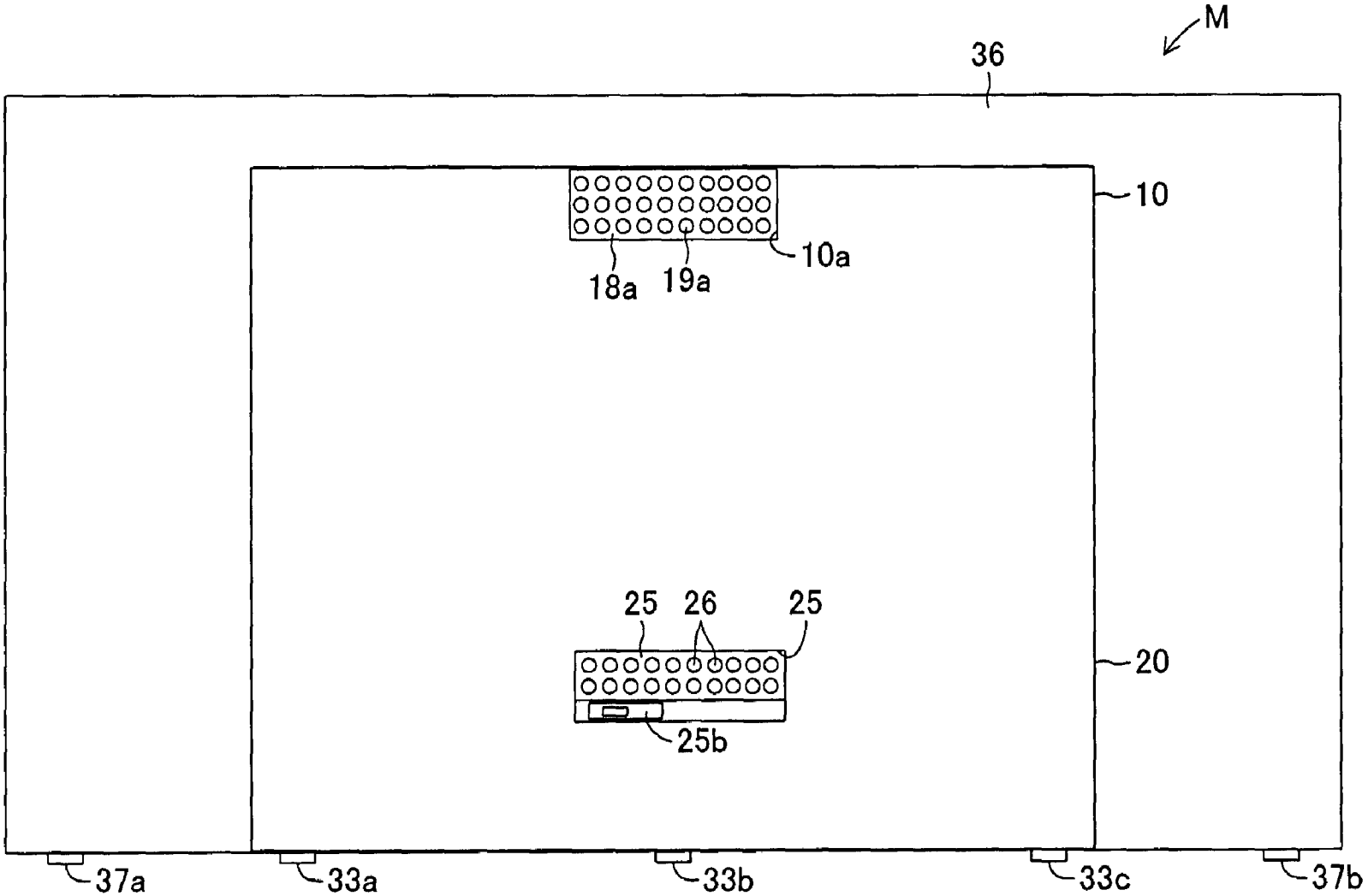
FIG. 7 is a rear view of the electronic keyboard instrument of FIG. 1.

As shown in FIG. 7, a recess 10*a* is formed substantially at the center of the rear surface of the keyboard attachment frame section 10. As shown in FIG. 4, recesses 10*b* and 10*c* are formed at opposite rear corner portions of the keyboard attachment frame section 10. The recess 10*a* is used to externally extend a connection cord 18 for connecting the electronic keyboard instrument M to another equipment. A plurality of small holes serving as ventilation holes 19*a* are formed in a front wall 18*a*, which serves as a front surface of the recess 10*a*. A plurality of small holes serving as ventilation holes 19*b* are formed in side walls 18*b* and 18*c*, which serve as side wall surfaces of the recesses 10*b* and 10*c*, respectively (the ventilation holes in the side wall 18*c* are not shown). A plurality of small holes serving as ventilation holes 19*d* are formed in a rear region of a bottom portion 10*d* of the keyboard attachment frame section 10. An opening 10*e* is formed in the bottom portion 10*d* to be located on the front side of the recess 10*a*.

The rear frame section 20 assumes a box-like form having a long length in the width direction and in the height direction and is joined to a rear central portion of the lower surface of the keyboard attachment frame section 10, thereby supporting a rear portion of the keyboard attachment frame section 10. The rear frame section 20 includes a rear body section 20*a* located at the center thereof and speaker boxes 30*a* and 30*b* located on opposite sides of the rear body section 20*a*. The rear body section 20*a* assumes a box-like form resembling a rectangular parallelepiped. A front wall portion 21*a* of the rear body section 20*a* is formed of a curved plate whose central portion with respect to the width direction is curved frontward. Pedals 22*a*, 22*b*, and 22*c*, which serve as foot controllers of the present invention, are provided at a bottom portion of the rear body section 20*a* in such a manner as to be equally spaced in the horizontal direction.

Hole portions 23*a*, 23*b*, and 23*c* are formed in a bottom region of the front wall portion 21*a* of the rear body section 20*a*. The pedals 22*a*, 22*b*, and 22*c* are provided in such a manner that their front portions project frontward from the corresponding hole portions 23*a*, 23*b*, and 23*c* in a vertically movable condition. Hole portions 24*a*, 24*b*, and 24*c* are also formed in a bottom region of the rear wall portion 21*b* of the rear body section 20*a* at positions corresponding to rear end portions of the pedals 22*a*, 22*b*, and 22*c*. Accordingly, the interior of a bottom portion of the rear body section 20*a* can be ventilated through the hole portions 23*a*, 23*b*, 23*c*, 24*a*, 24*b*, and 24*c*. Pedal sensors and a drive circuit board (not shown) are provided in the vicinity of the pedals 22*a*, 22*b*, and 22*c* at a bottom portion of the rear body section 20*a*.

A power line inlet 25 in the form of a recess is formed at the rear wall portion 21*b* of the rear body section 20*a* at a position located above the hole portions 24*a*, 24*b*, and 24*c*. A plurality of small holes serving as ventilation holes 26 are formed in an upper front wall portion 25*a* of the power line inlet 25. A connection device 25*b* for receiving power from an external source is attached to a bottom portion of the power line inlet 25. Various devices, such as a power transformer 27, a circuit board 28, and an amplifier 29, that generate heat when activated are mounted on the inner surface of the rear wall portion 21*b* of the rear body section 20*a*. The devices, such as the power transformer 27, constitute the electronic circuit according to the present invention.

The speaker boxes 30*a* and 30*b* are bilaterally symmetrical boxes each having the form of a rectangular parallelepiped and are disposed on opposite sides of the rear body section 20*a*. Speakers 31*a* and 31*b* are disposed in the speaker boxes 30*a* and 30*b*, respectively, in order to generate musical sound and sound effects in accordance with operations of keys and controllers. The bottom portion 10*d* of the keyboard attachment frame section 10 serves as an upper surface portion of each of the speaker boxes 30*a* and 30*b*. The ventilation holes 19*d* formed in the bottom portion 10*d* are adapted to regulate the sound of the speakers 31*a* and 31*b*. In order to facilitate the passage of sound, a perforated plate is used to form a front surface portion of each of the speaker boxes 30*a* and 30*b*.

Angle pieces serving as metal fixtures 32*a* and 32*b* are attached to lower end portions of the outer side surfaces of the speaker boxes 30*a* and 30*b*, respectively. Support projections 33*a*, 33*b*, and 33*c* are provided in opposite widthwise end regions and a central region, respectively, on a rear end portion of the bottom surface of the rear body section 20*a*. The support projections 33*a*, 33*b*, and 33*c* support the rear body section 20*a* such that the bottom surface of the rear body section 20*a* does not come into direct contact with the floor.

The leg sections 35*a* and 35*b* are fixed to opposite widthwise end regions of a front portion of the keyboard attachment frame section 10, thereby supporting the front portion of the keyboard attachment frame section 10. An inner region and a rear region of an upper portion of the leg section 35*a* and 35*b* are joined to the bottom surface of the keyboard attachment frame section 10 via reinforcement members 36*a* and 36*b*, respectively. As a result, the leg sections 35*a* and 35*b* are more firmly fixed to the keyboard attachment frame section 10. Support projections 37*a* and 37*b* are also provided on the corresponding bottom surfaces of the leg sections 35*a* and 35*b*. The support projections 33*a*, 33*b*, 33*c*, 37*a*, and 37*b* support the body of the electronic keyboard instrument M while a predetermined gap is maintained between the floor and the body of the electronic keyboard instrument M. In the electronic keyboard instrument M, the electronic circuit and various devices are connected by means of wiring lines (not shown).

When the thus-configured electronic keyboard instrument M is to be played, first, a performer connects a power supply to the connection device 25*b*, and connects the connection cord 18 to an apparatus required for performance; e.g., to a controller, thereby enabling playing of the electronic keyboard instrument M. Next, the performer opens the cover section 14, thereby exposing the keyboard section 11 and the operation panel section 12. Then, the performer turns on the power and operates the keys of the keyboard section 11, controllers of the operation panel section 12, and the pedals 22*a*, 22*b*, and 22*c*. As a result, the electronic keyboard instrument M generates musical sound and sound effects from the speakers 31*a* and 31*b* in accordance with the functions of the keys of the keyboard section 11, the controllers of the operation panel section 12, and the pedals 22*a*, 22*b*, and 22*c*.

In this case, air enters the interior of the rear body section 20*a* through the hole portions 23*a*, 23*b*, 23*c*, 24*a*, 24*b*, and 24*c* and the ventilation holes 26 and flows through the space in the rear body section 20*a* where the power transformer 27 and the like are provided. Subsequently, air enters the keyboard attachment frame section 10 through the opening 10*e* formed in an upper portion of the rear body section 20*a* and then flows out to the exterior of the keyboard attachment frame section 10 through the ventilation holes 19*a* formed in the rear surface of the keyboard attachment frame section 10 or through the ventilation holes 19*b* formed in the side surfaces of the keyboard attachment frame section 10. Accordingly, heat generated from the electronic circuit, which includes the power transformer 27 and the amplifier 29, is carried by air flow and efficiently released to the exterior of the electronic keyboard instrument M.

As a result, there can be prevented such a problem that the component devices of the electronic circuit provided in the interior of the rear body section 20*a* are heated to thereby be deteriorated or malfunction. Also, since no heat is stagnant in the interior of the keyboard attachment frame section 10, devices provided in the interior of the keyboard attachment frame section 10 are free from deterioration and malfunction which could otherwise be caused by heat. Thus, the respective sections of the electronic keyboard instrument M operate properly, so that musical sound and sound effects are properly generated from the speakers 31*a* and 31*b*.

As described above, in the electronic keyboard instrument M according to the present embodiment, the component devices, such as the power transformer 27, the circuit board 28, and the amplifier 29, of the electronic circuit are provided along the inner surface of the rear wall portion 21*b* of the rear body section 20*a*. Accordingly, the number of devices provided in the interior of the keyboard attachment frame section 10 reduces, so that the size of the keyboard attachment frame section 10 can be reduced. Also, the dimension of the rear body section 20*a* in the depth direction can be reduced. Thus, the overall size of the electronic keyboard instrument M can be reduced. Furthermore, since the front wall portion 21*a* of the rear body section 20*a* is formed such that its central portion with respect to the width direction is curved frontward, sufficient space is available for accommodation of the component devices of the electronic circuit and for establishment of an air flow path. Thus, there can be prevented the stagnation of heat in a space among devices which would otherwise be arranged in a packed condition in a narrow space, and difficulty in air flow.

The hole portions 23*a*, 23*b*, 23*c*, 24*a*, 24*b*, and 24*c* and the ventilation holes 26 are provided at a lower portion of the rear body section 20*a*; and the ventilation holes 19*a* and 19*b* are provided at the keyboard attachment frame section 10 located above the rear body section 20*a*. Accordingly, air enters the rear body section 20*a* though various hole portions formed at a lower portion of the rear body section 20*a* and exits to the exterior of the keyboard attachment frame section 10 through various ventilation holes formed at the keyboard attachment frame section 10. Thus, a plurality of air flow paths are formed in the interior of the rear body section 20*a* and in the interior of the keyboard attachment frame section 10. Therefore, without use of a fan or the like, heat generated in the interior of the rear body section 20*a*, together with air flows, is naturally released to the exterior of the electronic keyboard instrument M.

Furthermore, the hole portions 23*a*, 23*b*, and 23*c* are provided at the front wall portion 21*a* of the rear body section 20*a*; and the ventilation holes 26 and the ventilation holes 19*a* and 19*b* are formed at recesses, such as the power line inlet 25 and the recess 10*a*. Accordingly, even when the electronic keyboard instrument M is placed in such a manner that its rear wall surface is located in the vicinity of a wall surface, the flow of air is reliably generated in the interior of the rear body section 20*a*, so that heat generated from the electronic circuit is carried by air flow and efficiently released to the exterior of the electronic keyboard instrument M through upper ventilation holes. Accordingly, regardless of where the electronic keyboard instrument M is placed, the stagnation of heat in the interior of the rear body section 20*a* is prevented; thus, even when devices provided in the electronic keyboard instrument M include components susceptible to heat, the devices operate properly.

According to a modification of the above-described embodiment, additional ventilation holes (not shown) may be formed in partition wall sections between the rear body section 20*a* and the speaker boxes 30*a* and 30*b*. Air in the interior of the rear body section 20*a* partially enters the speaker boxes 30*a* and 30*b* through the ventilation holes formed in the partition wall sections and then enters the keyboard attachment frame section 10 through the ventilation holes 19*d*. Then, air exits to the exterior of the keyboard attachment frame section 10 through the ventilation holes 19*a* and 19*b*. Accordingly, the heat release effect is enhanced; and the ventilation holes 19*d* function not only to regulate sound quality but also to improve the performance of ventilation.

The electronic keyboard instrument M according to the present invention is not limited to the above-described embodiment, but may be embodied in various other forms as appropriate. For example, in the above-described embodiment, the ventilation holes 19*a* and 19*b*, through which heat carried by air is released to the exterior of the electronic keyboard instrument M, are provided at the keyboard attachment frame section 10. However, the ventilation holes 19*a* and 19*b* may be provided at an upper portion of the rear body section 20*a*. The lower ventilation holes consisting of the hole portions 23*a*, 23*b*, 23*c*, 24*a*, 24*b*, and 24*c* and the ventilation holes 26 are provided preferably below the electronic circuit, but may be provided at a level equivalent to or slightly higher than the level of the electronic circuit. Even when the lower ventilation holes are provided at a level higher than the level of the electronic circuit, since heat ascends, heat is carried by air flow, if any, and released to the exterior.

In the above-described embodiment, a lower end portion of the rear body section 20*a* extends to the vicinity of the floor. However, the lower end portion of the rear body section may be raised more such that the pedals are provided below the lower end portion via a connection section. In this case, the lower ventilation holes are provided at a bottom portion of the rear body section. Additionally, the electronic keyboard instrument according to the present invention may be modified in configuration, such as the shape of component sections and portions, without departing from the scope of the invention.

What is claimed is:

1. An electronic keyboard instrument comprising: a frame body comprising a keyboard attachment frame section and a rear frame section and having a space section formed therein, the keyboard attachment frame section having a keyboard, and the rear frame section being connected to a rear portion of a lower surface of the keyboard attachment frame section and having a foot controller provided at a bottom portion thereof or provided therebelow via a connection section; and an electronic circuit generating heat when activated; wherein the electronic circuit is provided in the interior of the rear frame section; and a ventilation hole communicating with the exterior of the frame body is provided at a lower portion of the rear frame section and provided at a portion of the frame body located above the electronic circuit, wherein the ventilation hole provided at a portion of the frame body located above the electronic circuit is located at the rear frame section, and wherein the electronic circuit is formed on a predetermined plane, and is disposed vertically in such a manner that the plane extends along an inner wall surface of the rear frame section.

2. An electronic keyboard instrument according to claim 1, wherein the ventilation hole provided at a lower portion of the rear frame section is located below the electronic circuit.

3. An electronic keyboard instrument according to claim 2, wherein the foot controller is a pedal projecting from a projection opening provided at a bottom portion of the rear frame section; and the projection opening serves as the ventilation hole provided at a lower portion of the rear frame section.

4. An electronic keyboard instrument comprising: a frame body comprising a keyboard attachment frame section and a rear frame section and having a space section formed therein, the keyboard attachment frame section having a keyboard, and the rear frame section being connected to a rear portion of a lower surface of the keyboard attachment frame section and having a foot controller provided at a bottom portion thereof or provided therebelow via a connection section; and an electronic circuit generating heat when activated; wherein the electronic circuit is provided in the interior of the rear frame section; and a ventilation hole communicating with the exterior of the frame body is provided at a lower portion of the rear frame section and provided at a portion of the frame body located above the electronic circuit, wherein the ventilation hole provided at a portion of the frame body located above the electronic circuit is located at the rear frame section, and wherein the ventilation hole provided at a lower portion of the rear frame section is located below the electronic circuit.

5. An electronic keyboard instrument according to claim 4, wherein the foot controller is a pedal projecting from a projection opening provided at a bottom portion of the rear frame section; and the projection opening serves as the ventilation hole provided at a lower portion of the rear frame section.

6. An electronic keyboard instrument comprising: a frame body comprising a keyboard attachment frame section and a rear frame section and having a space section formed therein, the keyboard attachment frame section having a keyboard, and the rear frame section being connected to a rear portion of a lower surface of the keyboard attachment frame section and having a foot controller provided at a bottom portion thereof or provided therebelow via a connection section; and an electronic circuit generating heat when activated; wherein the electronic circuit is provided in the interior of the rear frame section; and a ventilation hole communicating with the exterior of the frame body is provided at a lower portion of the rear frame section and provided at a portion of the frame body located above the electronic circuit, wherein the ventilation hole provided at a portion of the frame body located above the electronic circuit is located at the rear frame section, and wherein the foot controller is a pedal projecting from a projection opening provided at a bottom portion of the rear frame section; and the projection opening serves as the ventilation hole provided at a lower portion of the rear frame section.

7. An electronic keyboard instrument comprising: a frame body comprising a keyboard attachment frame section and a rear frame section and having a space section formed therein, the keyboard attachment frame section having a keyboard, and the rear frame section being connected to a rear portion of a lower surface of the keyboard attachment frame section and having a foot controller provided at a bottom portion thereof or provided therebelow via a connection section; and an electronic circuit generating heat when activated; wherein the electronic circuit is provided in the interior of the rear frame section; and a ventilation hole communicating with the exterior of the frame body is provided at a lower portion of the rear frame section and provided at a portion of the frame body located above the electronic circuit, wherein the ventilation hole provided at a portion of the frame body located above the electronic circuit is located at the rear frame section, and wherein the ventilation hole provided at a portion of the frame body located above the electronic circuit is located at the keyboard attachment frame section.

8. An electronic keyboard instrument according to claim 7, wherein the electronic circuit is formed on a predetermined plane, and is disposed vertically in such a manner that the plane extends along an inner wall surface of the rear frame section.

9. An electronic keyboard instrument according to claim 8, wherein the ventilation hole provided at a lower portion of the rear frame section is located below the electronic circuit.

10. An electronic keyboard instrument according to claim 9, wherein the foot controller is a pedal projecting from a projection opening provided at a bottom portion of the rear frame section; and the projection opening serves as the ventilation hole provided at a lower portion of the rear frame section.

11. An electronic keyboard instrument according to claim 7, wherein the ventilation hole provided at a lower portion of the rear frame section is located below the electronic circuit.

12. An electronic keyboard instrument according to claim 11, wherein the foot controller is a pedal projecting from a projection opening provided at a bottom portion of the rear frame section; and the projection opening serves as the ventilation hole provided at a lower portion of the rear frame section.

13. An electronic keyboard instrument according to claim 7, wherein the foot controller is a pedal projecting from a projection opening provided at a bottom portion of the rear frame section; and the projection opening serves as the ventilation hole provided at a lower portion of the rear frame section.

14. An electronic keyboard instrument comprising: a frame body comprising a keyboard attachment frame section and a rear frame section and having a space section formed therein, the keyboard attachment frame section having a keyboard, and the rear frame section being connected to a rear portion of a lower surface of the keyboard attachment frame section and having a foot controller provided at a bottom portion thereof or provided therebelow via a connection section; and an electronic circuit generating heat when activated; wherein the electronic circuit is provided in the interior of the rear frame section; and a ventilation hole communicating with the exterior of the frame body is provided at a lower portion of the rear frame section and provided at a portion of the frame body located above the electronic circuit, wherein the ventilation hole provided at a portion of the frame body located above the electronic circuit is located at the rear frame section, and wherein a power line inlet is provided at a rear surface of the frame body; and the ventilation hole provided at a portion of the frame body located above the electronic circuit is located in a peripheral region of the power line inlet.

15. An electronic keyboard instrument according to claim 14, wherein the electronic circuit is formed on a predetermined plane, and is disposed vertically in such a manner that the plane extends along an inner wall surface of the rear frame section.

16. An electronic keyboard instrument according to claim 15, wherein the ventilation hole provided at a lower portion of the rear frame section is located below the electronic circuit.

17. An electronic keyboard instrument according to claim 16, wherein the foot controller is a pedal projecting from a projection opening provided at a bottom portion of the rear frame section; and the projection opening serves as the ventilation hole provided at a lower portion of the rear frame section.

18. An electronic keyboard instrument comprising: a frame body comprising a keyboard attachment frame section and a rear frame section and having a space section formed therein, the keyboard attachment frame section having a keyboard, and the rear frame section being connected to a rear portion of a lower surface of the keyboard attachment frame section and having a foot controller provided at a bottom portion thereof or provided therebelow via a connection section; and an electronic circuit generating heat when activated; wherein the electronic circuit is provided in the interior of the rear frame section; and a ventilation hole communicating with the exterior of the frame body is provided at a lower portion of the rear frame section and provided at a portion of the frame body located above the electronic circuit, wherein the ventilation hole provided at a portion of the frame body located above the electronic circuit is located at the rear frame section, and wherein the electronic circuit is composed of a power transformer, a circuit board, and an amplifier.

* * * * *